United States Patent [19]

Marrero

[11] 4,338,653

[45] Jul. 6, 1982

[54] VERSATILE FLUORESCENT LIGHTING FIXTURE

[76] Inventor: Louis Marrero, 1209 Via Ramon, Escondido, Calif. 92025

[21] Appl. No.: 190,466

[22] Filed: Sep. 24, 1980

[51] Int. Cl.[3] ..... F21S 3/00

[52] U.S. Cl. ..... 362/223; 362/147; 362/151; 362/217; 362/260; 362/432

[58] Field of Search ..... 362/147, 151, 217, 223, 362/260, 432, 433, 455

[56] References Cited

U.S. PATENT DOCUMENTS 4,088,881 5/1978 Neer ..... 362/223

4,246,629 1/1981 Marrero ..... 362/147

4,251,855 2/1981 Radek ..... 362/151

*Primary Examiner*—Donald P. Walsh

*Attorney, Agent, or Firm*—Ralph S. Branscomb

[57] ABSTRACT

A versatile fluorescent lighting fixture is provided having a housing which will flush mount in either a corner or on a wall or ceiling surface, there being a recessed track in the back into which mounting plates slide. The front of the housing is adapted to accept either a translucent shield for direct lighting or an opaque reflector apparatus spaced somewhat from the housing for indirect lighting.

7 Claims, 11 Drawing Figures

VERSATILE FLUORESCENT LIGHTING FIXTURE

BACKGROUND

The instant application is a continuation in part of an application entitled FLUORESCENT LIGHT FIXTURE having Ser. No. 084,836, filed Oct. 15, 1979, U.S. Pat. No. 4,246,629. The parent application pertains to a fluorescent structure that had a mounting mechanism equally adaptable to corner mounts, flat surface mounts or a hanging mount. The mounting versatility of that fixture is unsurpassed.

With increased development however, that basic concept has been moved forward in several directions and new, advantageous features have been developed which are the subject matter of this continuation-in-part application.

SUMMARY

The instant application carries forward the ability of the parent fixture to mount in corners or on a flat surface buy utilizes a somewhat simpler and more direct structure to accomplish this. Instead of the sheet metal housing with the wrap-around mounting bracket, the present invention utilizes an elongated housing open to the front and having a recessed track in the back into which slides a pair of mounting plates.

The front of the housing, by virtue of a pair of parallel slots extending the length of the housing and defined in the front of the rear wall, can accommodate in any position fluorescent tube mounting sockets, the transformer/ballast, and if desired a reflector apparatus useful particularly in conjunction of the linear corner mounting mode for creating indirect lighting.

Additionally, bays and grooves are provided in the housing to accommodate both the transformer/ballast cover and a translucent lens spanning the front of the housing which is used as an alternative to the reflector in event direct, rather than indirect, light is preferred.

DETAILED DESCRIPTION OF THE PREFERRED EMBODIMENT

Figure 1:
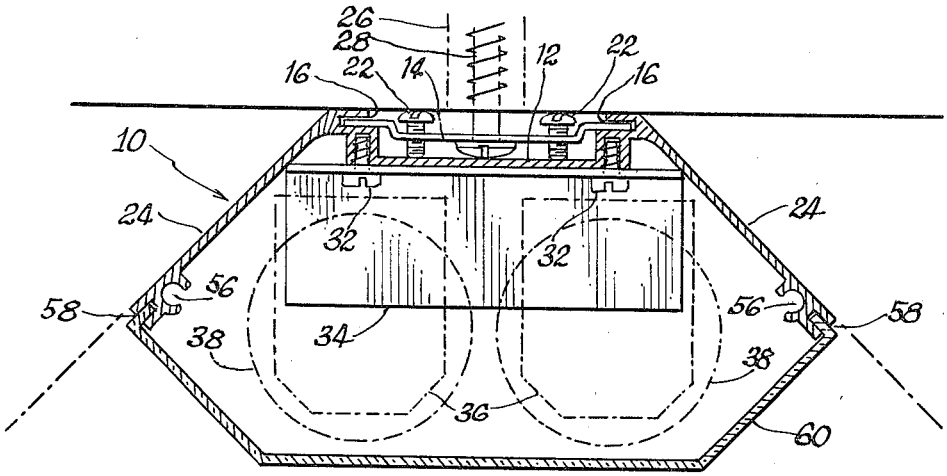
FIG. 1 is a section taken along Line 1—1 of FIG. 6 with the fluorescent tubes and sockets shown in dotted line and including the flush-mount ceiling position.
Figure 2:
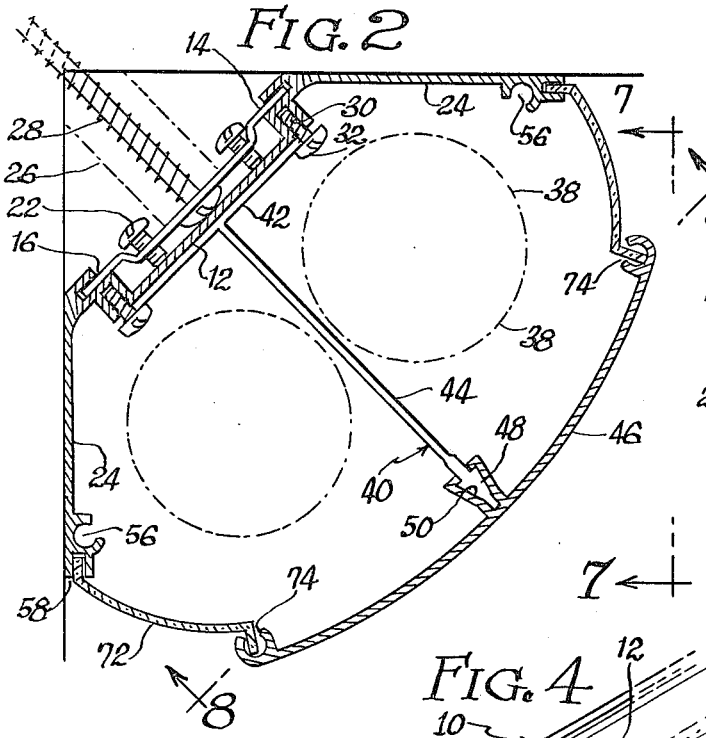
FIG. 2 is a section taken adjacent the mounting slide illustrating the unit mounted in a corner and having the reflector shield option.
Figure 3:
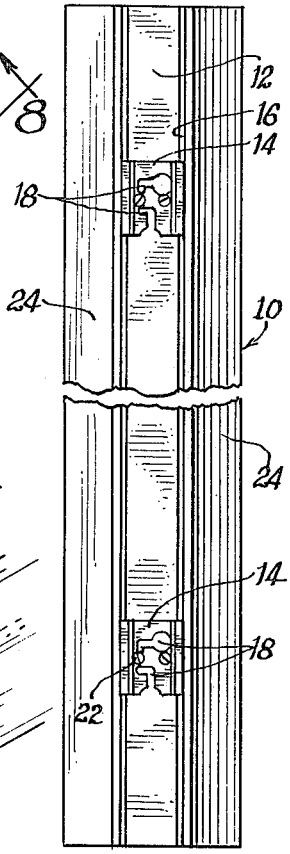
FIG. 3 is a rear elevation view of the fixture.
Figure 5:
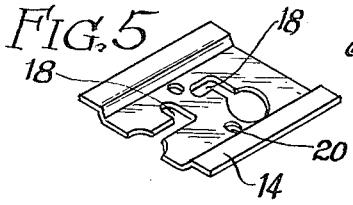
FIG. 5 is a perspective of the universal mounting plate.
Figure 6:
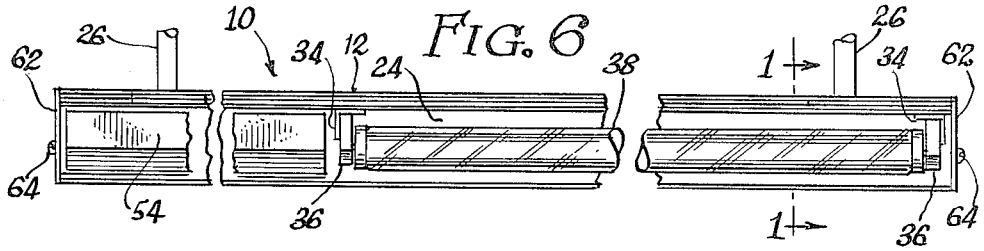
FIG. 6 is a side elevation view of the device as it would appear from the right of FIG. 1, with portions cut away.
Figure 7:
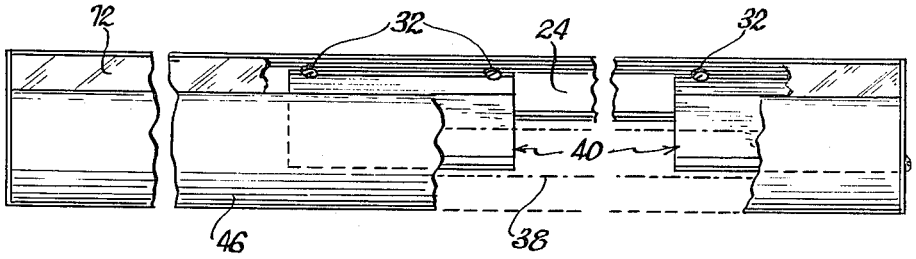
FIG. 7 is an elevation view along Line 7—7 of FIG. 2 with portions cut away.

The basic element of the fixture is the housing 10 which adapts the fluorescent tube structure to the surface to which it must be mounted, acts as a reflector, and generally holds all the parts together. The housing has a rear wall 12 which is recessed to provide space for the universal mounting plate 14, normally provided in pairs, which slidably seats in the track provided at 16. The mounting plate is shown in FIG. 5 and preferably includes two hanging eyelets 18 oriented at 90° relative to one another for vertical or horizontal mounting. A pair of set screw holes 20 accommodate self-taping set screws 22 which are used to set the mounting plates in the recessed rear wall as shown in FIGS. 1 and 2. As can best be seen in FIG. 1, the mounting plate has a central indented portion to permit clearance of the heads of the set screws 22 so that the rear wall 12 may be flush-mounted against a flat surface—such as the ceiling indicated at 23 in FIG. 1.

The housing 12 also defines a pair of side walls 24 which angle out at a 45° angle to the rear wall 12 to permit corner mounting as shown in FIG. 2. For corner mounting or when suspending the unit from the ceiling rather than flush-mounting it, spacers 26 can be used around mounting screws 28. Regardless of the style of mounting however, because of the freedom of the universal mounting plate to slide in the track 16, the fixture can be mounted equally easily regardless of stud spacing or the spacing of overhead rafters.

The inside of the housing defines forward-facing parallel slots 30 which extend the entire length of the housing. These slots can be used with mounting screws 32 at any point therealong to engage the component parts needed in the fluorescent fixture.

One of these component parts is the bracket 34 which mounts the fluorescent tube sockets 36. The bracket shown mounts dual sockets, which in turn of course mount dual tubes 38.

Figure 8:
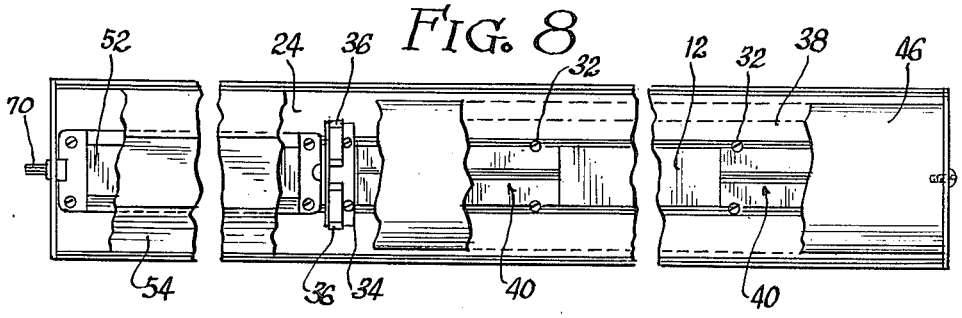
FIG. 8 is a frontal elevation view of the unit of FIG. 2 with portions cut away.
Figure 9:
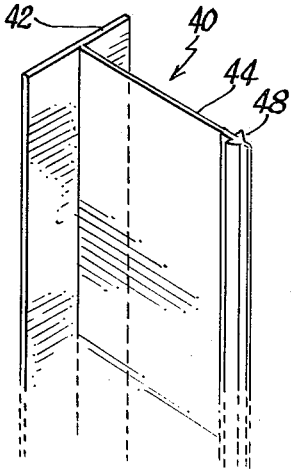
FIG. 9 is a perspective view a portion of the T-bar.
Figure 10:
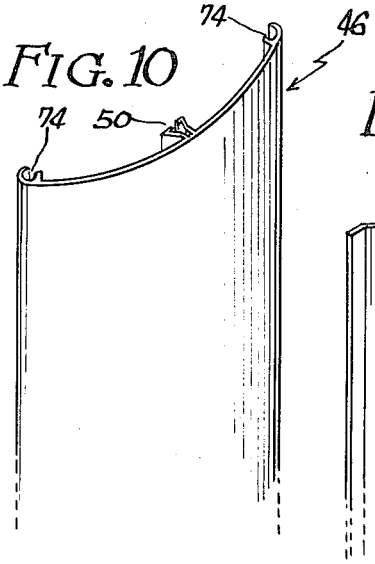
FIG. 10 is a perspective view of a portion of the reflector shield.

Another element that can be mounted to the screw slots is the T-bar support 40 shown in part in FIG. 9. The T-bar has a crossbar web portion 42 the same width as the inter-slot spacing so that, as shown in FIG. 8, it can be captured between mounting screws anywhere along its length. The fluorescent tube socket mounting brackets can be mounted over the web of the T, although of course individual sockets must be used as the dual socket bracket 34 obviously would conflict with the stem web 44.

The T-bar support can be used to space a lens or a reflector in front of the fluorescent tubes. In these illustrations, it is used to mount the reflector, or indirect light shield, 46, which is opaque with a silvered rear surface to create an indirect lighting effect. The T-bar has an elongated bead 48 at its forward edge which slidingly engages the longitudinal socket 50 in the reflector 46. In similar fashion, a lens could be substituted for the reflector for a direct lighting effect.

Figure 11:
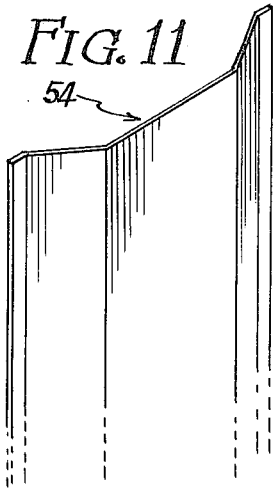
FIG. 11 is a perspective view of one end of the ballast cover.

The screw slots are also used to mount the ballast/-transformer 52, best seen in FIG. 8. The ballast casing has bolts which align with the mounting slots, and a ballast cover 54, shown in FIG. 11, can be slidably seated in the elongated bays 56 as shown in FIG. 8.

Figure 4:
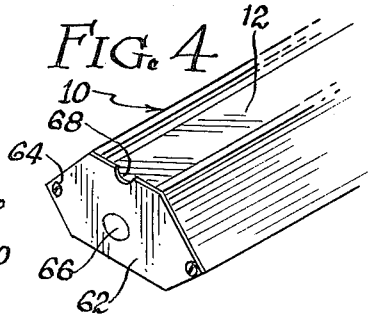
FIG. 4 is an end rear perspective of one end of the fixture.

In addition to the bays 56, the housing 10 defines generally forwardly directed channels 58 to receive the translucent lens 60 as best shown in FIG. 1. The lens can either slide or be snapped into place and is prevented from longitudinal motion by means of end caps 62 which have a planform substantially identical to the perimiter of the arrangement shown in FIG. 1, as indicated in FIG. 4. Screws 64 connect the end caps into the ends of the elongated ballast cover bays 56 in self-threading fashion. The end caps have a knock-out 66 for wiring either to a current source or to an adjoining fixture. A cut out 68 is also provided in the event it is desired to run wiring along behind the rear wall 12 of the unit, in the event of which the knock-out 66 may be used for a switch, such as switch 70 shown in FIG. 8.

As indicated above, the channels 58 hold the lens 60 in place. When a continuous lens such as lens 60 is not used but rather the reflector is used for indirect lighting, the space alongside the reflector can be left open, or it may be enclosed by side lenses 72 which snap into the bays 74 of the reflector and the channels 58 in the housing. The bags 74, being more cylindrical than slot-like, permit the side lenses to be inserted first into these bays and then swung around into position to snap into the slotted channels 58.

Thus, the unit as shown and described is one of improved universality of placement and mode of utilization, being adapted to flush-mounting on flat or linear corner surfaces, or being suspended from the ceiling or space from a wall. Additionally, the wide latitude of application provided by the longitudinal screw slots permit the fixture to be used in any length, and with either a translucent lens front cover, or an opaque reflective front to produce indirect lighting, of a special utility in linear corners.

What is claimed is:

1. A fluorescent light fixture comprising:

(a) an elongated housing;

(b) means on the back of said housing for mounting same; and (c) universal mounting means defined in the front of said housing and extending the substantial length thereof for alternatively or collectively mounting fluorescent sockets, a frontal reflector assembly, and transformer/ballast, said universal mounting means comprising a pair of parallel forward facing slots defined in said housing and extending the substantial length of same, and said sockets, reflector assembly, and transformer each defines at least one mounting panel mountable by means of screws engageable in said slots to capture said panels by the opposite edges thereof.

2. Structure according to claim 1 wherein said housing is an extrusion having holes defined in the ends thereof by extruded longitudinal bays and including a pair of end caps of planform to conform to said channels and lens having holes mating with said holes for screw-mounting said end caps to said housing.

3. Structure according to claim 2 and including a transformer cover dimensioned to be inserted into said longitudinal bays.

4. Structure according to claim 1 wherein said reflector assembly comprises an elongated support of T-shaped cross section having the cross-bar web portion dimensioned to lie between said slots and be captured therein by screws, and the stem portion extending out frontally of said housing to slidably mate by means of a longitudinally extended bead and a longitudinal socket structure with an opaque reflector shield.

5. Structure according to claim 4 said elongated housing is forwardly open having sidewalls defining channels and the edges of said shield define longitudinal bay-shaped channels and including translucent side lenses dimensioned to slide into said bay-shaped channels in said reflector shield and span into the channels defined by said housing.

6. A fluorescent lighting fixture comprising:

(a) an elongated housing and means for mounting fluorescent tubes and ballast therein;

(b) a longitudinally extended tract defined in the rear of said housing and extending the substantial length thereof; and (c) a pair of universal mounting plates being slidable in said track and having means to mount same to a surface comprising a pear-shaped opening to engage a screw head extended from the mounting surface and forwardly-directed set screws to secure same against sliding in said track.

7. Structure according to claim 6 wherein said housing includes a plane-defining rear wall having said track recessed therein to recess the heads of said set screws so said rear wall will mount flush against a wall, and a pair of side walls extending from said rear wall at 45° angles whereby said housing will fit flush against either a planar surface or in an orthogonal linear corner.

* * * * *